US005532027A

United States Patent [19]

Nordstrom et al.

[11] Patent Number: 5,532,027

[45] Date of Patent: Jul. 2, 1996

[54] UV LIGHT TREATMENT OF CLEAR COAT TO IMPROVE ACID ETCH RESISTANCE

[75] Inventors: J. David Nordstrom, Detroit; Hisanori Omura, Farmington Hills; Alan E. Smith, Troy; David M. Thomson, Mt. Clemens, all of Mich.

[73] Assignee: E. I. Du Pont de Nemours and Company, Wilmington, Del.

[21] Appl. No.: 360,557

[22] Filed: Dec. 21, 1994

[51] Int. Cl.[6] ..... B05D 3/06

[52] U.S. Cl. ..... 427/493; 427/409; 427/419.7; 427/512; 427/515; 427/518; 427/519; 427/387

[58] Field of Search ..... 427/493, 512, 427/514, 515, 517, 518, 519, 387, 409, 412.1, 419.7

[56] References Cited

U.S. PATENT DOCUMENTS 4,499,151 2/1985 Dowbenko et al. ..... 428/447
5,106,651 4/1992 Tyger et al. ..... 427/54.1

FOREIGN PATENT DOCUMENTS 134645 3/1979 Germany .
1-155971 6/1989 Japan .
1-55971 6/1989 Japan .

OTHER PUBLICATIONS

Abstract of JP 05-161,869, Jun. 1993.
Abstract of JP 05-161870, Jun. 1993.

*Primary Examiner*—Shrive Beck
*Assistant Examiner*—Erma Cameron
*Attorney, Agent, or Firm*—Hilmar L. Fricke

[57] ABSTRACT

An improved process which comprises applying a layer of a color coating composition to a substrate used for the exterior of a motor vehicle and then applying a layer of a clear coating composition to the color coating and curing the resulting clear coat/color coat layer; the improvement is the use of a clear coating composition containing a film forming binder of an acrylosilane polymer and exposing the clear coat layer after curing to an artificial source of UV light under ambient temperatures and atmospheric conditions in an amount sufficient to improve the resistance of the clear coat to water spotting and acid etching when exposed to natural weathering conditions.

7 Claims, No Drawings

UV LIGHT TREATMENT OF CLEAR COAT TO IMPROVE ACID ETCH RESISTANCE

BACKGROUND OF THE INVENTION

1. Field of the Invention

This invention is directed to UV (ultraviolet light) treatment of a clear coating to improve the acid etch resistance of the composition. In particular, this invention is directed to the UV treatment of a clear coating applied over a color coating of a motor vehicle such as an automobile or a truck to improve the acid etch resistance of the color coat.

2. Description of the Prior Art

Acid rain an other air pollutants have caused problems of water spotting and acid etching of finishes used on automobiles and trucks. The finish of choice presently being used on the exterior of automobiles and trucks is a clear coat/color coat finish in which a clear coating is applied over a color coat which is pigmented to provide protection to the color coat and improve the appearance of the overall finish such as gloss and distinctness of image. In an effort to solve these problems, U.S. Pat. No. 5,106,651 to Tyger et al issued Apr. 21, 1992 provides for UV treatment of clear coating of polymer containing active hydrogen such as acrylic polymers and an aminoplast crosslinking agent. However, there is no recognition or suggestion that other coating composition that did not contain an aminoplast resin would be affected by UV treatment in particular, silane containing coating which form particularly high quality clear coat and have excellent hardness and gloss.

There is a need for a process to treat silane containing clear coatings to form finishes that are resistant to acid etching and water spotting caused by acid rain.

SUMMARY OF THE INVENTION

An improved process which comprises applying a layer of a color coating composition to a substrate used for the exterior of a motor vehicle and then applying a layer of a clear coating composition to the color coating and curing the resulting clear coat/color coat layer; the improvement is the use of a clear coating composition containing a film forming binder of an acrylosilane polymer and exposing the clear coat layer after curing to an artificial source of UV light under ambient temperatures and atmospheric conditions in an amount sufficient to improve the resistance of the clear coat to water spotting and acid etching when exposed to natural weathering conditions.

DETAILED DESCRIPTION OF THE INVENTION

This invention is particularly useful for improving the acid etch resistance and water spotting resistance of the clear coat of a clear coat/color coat finish used on the exterior of automobiles and tracks or exterior parts of such automobiles and trucks. The invention does not encompass conventional test proceedures used for coatings. It is well known that in testing coated paint panels, panels are exposed to an artificial source of UV light for purposes of accelerated weathering testing, e.g. in a WEATHER-O-METER or a Q.U.V. exposure device. The present invention does not apply to such articles used for experimental testing.

In regard to the aforementioned U.S. Pat. No. 5,106,651, it was surprising and unexpected to find that a coating containing an acrylosilane polymer with out the presence of an aminoplast curing agent responded to UV light treatment and improved the acid etch and water spot resistance of the coating particularly when the patent required the presence of an aminoplast curing agent with a film forming polymer. There is no suggestion in the aforementioned patent that a clear coating of an acrylosilane polymer by itself without the presence of an aminoplast curing agent when treated with UV light would improve acid etch and water spot resistance of the coating.

In a typical body of a motor vehicle, such as an automobile or a truck, the substrate is steel or can be a plastic or a composite. If it is a steel substrate, it is first treated with an inorganic rust-proofing zinc or iron phosphate layer and then a primer is applied by electrocoating. Typically, these primers are epoxy modified resins crosslinked with a polyisocyanate and are applied by a cathodic electrocoating process. Optionally, a primer surfacer can be applied over the electrodeposited primer to provide for better appearance and/or improved adhesion of the basecoat to the primer. A pigmented basecoat or color coat then is applied. A typical basecoat comprises pigment which can include metallic flake pigments such as aluminum flake, and a film forming binder which can be a polyurethane, an acrylourethane, an acrylic polymer, an acrylosilane polymer, and a crosslinking agent such as an aminoplast, typically, an alkylated melamine formaldehyde crosslinking agent or a polyisocyanate. The basecoat can be solvent or water home and can be in the form of a dispersion or a solution.

A clear top coat (clear coat) then is applied to the basecoat before the basecoat is fully cured and the basecoat and clear coat are then fully cured usually by baking at about 100°–150° C. for about 15–45 minutes. The basecoat and clear coat preferably have a dry coating thickness of about 2.5–75 microns and 25–100 microns, respectively.

The film forming polymer of the clear coat composition comprises an acrylosilane polymer. Suitable acrylosilane polymers have a weight average molecular weight of about 1,000–30,000. All molecular weights disclosed herein are determined by gel permeation chromatography (GPC) using a polystyrene standard, unless otherwise noted.

A wide variety of acrylosilane polymers which contain curable silane groups may be used in the clear coating composition. One preferred acrylosilane polymer is the polymerization product of, by weight, about 30–95%, preferably 85–45% ethylenically unsaturated non-silane containing monomers and about 5–70%, preferably 15–55% ethylenically unsaturated silane containing monomers, based on the weight of the acrylosilane polymer.

Typical ethylenically unsaturated non-silane containing monomers are alkyl acrylates, alkyl methacrylates and any mixtures thereof, where the alkyl groups have 1–12 carbon atoms, preferably 3–8 carbon atoms. Such monomers are methyl methacrylate, ethyl methacrylate, propyl methacrylate, butyl methacrylate, isobutyl methacrylate, pentyl methacrylate, hexyl methacrylate, octyl methacrylate, nonyl methacrylate, lauryl methacrylate and the like; alkyl acrylate monomers include methyl acrylate, ethyl acrylate, proply acrylate, butyl acrylate, isobutyl acrylate, pentyl acrylate, hexyl acrylate, octyl acrylate, nonyl acrylate, lauryl acrylate and the like. Cycloaliphatic methacrylates and acrylates also can be used, for example, such as trimethylcyclohexyl methacrylate, trimethylcyclohexyl acrylate, iso-butyl methacrylate, t-butyl cyclohexyl acrylate, or t-butyl cyclohexyl methacrylate. Aryl acrylate and aryl methacrylates also can be used, for example, such as benzyl acrylate and benzyl methacrylate. Mixtures of two or more of the above mentioned monomers are also useful.

In addition to alkyl acrylates or methacrylates, other non-silane containing polymerizable monomers, up to about 50% by weight of the polymer, can be used in an acrylosilane polymer for the purpose of achieving the desired physical properties such as hardness, appearance, mar resistance, and the like. Exemplary of such other monomers are styrene, methyl styrene, acrylamide, acrylonitrile, methacrylonitrile, and the like. Styrene can be used in the range of 0–50% by weight.

Hydroxy functional monomers may be incorporated into the acrylosilane polymer to produce a polymer having a hydroxy number of 20 to 160. Typically useful hydroxy functional monomers are alkyl methacrylates and acrylates such as hydroxy ethyl methacrylate, hydroxy propyl methacrylate, hydroxy butyl methacrylates, hydroxy isobutyl methacrylate, hydroxy ethyl acrylate, hydroxy propyl acrylate, hydroxy butyl acrylate, and the like.

A suitable silane containing monomer useful in forming an acrylosilane polymer is an alkoxysilane having the following structural formula:

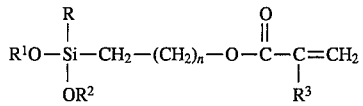

wherein R is either $CH_3$, $CH_3CH_2$, $CH_3O$, or $CH_3CH_2O$; $R^1$ and $R^2$ are $CH_3$ or $CH_3CH_2$; $R_3$ is either H, $CH_3$, or $CH_3CH_2$; and n is 0 or a positive integer from 1 to 10. Preferably, R is $CH_3O$ or $CH_3CH_2O$ and n is 1.

Typical examples of such alkoxysilanes are the acrylate alkoxy silanes, such as gammaacryloxypropyltrimethoxy silane and the methacrylate alkoxy silanes, such as gamma-methacryloxypropyltrimethoxy silane, and gamma-methacryloxypropyltris(2-methoxyethoxy) silane.

Other suitable alkoxy silane monomers have the following structural formula:

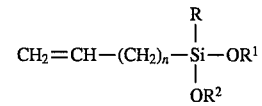

wherein R, $R^1$ and $R^2$ are as described above and n is a positive integer from 1 to 10.

Examples of such alkoxysilanes are the vinylalkoxy silanes, such as vinyltrimethoxy silane, vinyltriethoxy silane and vinyltris(2-methoxyethoxy) silane.

Other useful silane containing monomers are acyloxysilanes, including acrylatoxy silane, methacrylatoxy silane and vinylacetoxy silanes, such as vinylmethyl diacetoxy silane, acrylatopropyl triacetoxy silane, and methacrylatopropyltriacetoxy silane. Mixtures of the above-mentioned silane-containing monomers are also suitable.

Consistent with the above mentioned components of the silane polymer, an example of an acrylosilane polymer useful in the coating composition of this invention may contain the following constituents: about 25–35% by weight styrene, 25–35% by weight isobutyl methacrylate, 1–10% by weight butyl methacrylate, 10–20% by weight hydroxypropyl acrylate and 25–35% by weight gammamethacryloxypropyltrimethoxy silane.

The acrylosilane polymer is prepared by a conventional solution polymerization process in which the monomers, solvents and polymerization catalyst are heated to about 120°–160° C. for about 2–4 hours to form the polymers.

Typical polymerization catalysts are azo type catalysts such as azo-bis-isobutyronitrile, acetate catalysts such as t-butyl peracetate, di-t-butyl peroxide, t-butyl perbenzoate, t-butyl peroctoate and the like.

Typical solvents that can be used are ketones such as methyl amyl ketone, isobutyl ketone, methyl ethyl ketone, aromatic hydrocarbons such as toluene, xylene, ethers, esters, alcohols, acetates and mixtures of any of the above.

Silane functional macromonomers also can be used in forming the acrylosilane polymer. For example, one such macromonomer is the reaction product of a silane containing compound, having a reactive group such as epoxide or isocyanate, with an ethylenically unsaturated non-silane containing monomer having a reactive group, typically a hydroxyl or an epoxide group, that is co-reactive with the silane monomer. An example of a useful macromonomer is the reaction product of a hydroxy functional ethylenically unsaturated monomer such as a hydroxyalkyl acrylate or methacrylate having 1–4 carbon atoms in the alkyl group and an isocyanatoalkyl alkoxysilane such as isocyanatopropyl triethoxysilane.

Typical of such above mentioned silane functional macromonomers are those having the following structural formula:

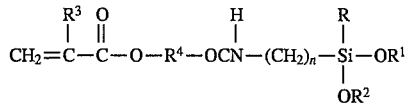

wherein R, $R^1$, $R^2$ and $R^3$ are as described above; $R^4$ an alkylene group having 1–8 carbon atoms and n is a positive integer from 1–8.

Curing catalysts for catalyzing the crosslinking between silane moieties of the acrylosilane polymer and/or between silane moieties and other components of the composition include dibutyl tin dilaurate, dibutyl tin diacetate, dibutyl tin dichloride, dibutyl tin dibromide, triphenyl boron, tetraisopropyl titanate, triethanolamine titanate chelate, dibutyl tin dioxide, dibutyl tin dioctoate, tin octoate, aluminum titanate, aluminum chelates, zirconium chelate, and other such catalysts or mixtures thereof known to those skilled in the art. Tertiary amines and acids or combinations thereof are also useful for catalyzing silane bonding. Other silane curing catalysts are disclosed in U.S. Pat. No. 4,923,945, column 15 to column 17, herein incorporated by reference.

Although not needed to obtain the improvements of UV exposure, the acrylosilane clear coat can contain about 10–50% by weight, based on the weight of the binder of a conventional monomeric or polymeric alkylated melamine formaldehyde crosslinking agent that is partially or fully alkylated. One preferred crosslinking agent is a methylated and butylated or isobutylated melamine formaldehyde resin that has a degree of polymerization of about 1–3. Generally, this melamine formaldehyde resin contains about 50% butylated groups or isobutylated groups and 50% methylated groups. Such crosslinking agents typically have a number average molecular weight of about 300–600 and a weight average molecular weight of about 500–1500. Examples of commercially available resins are "Cymel" 1168, "Cymel" 1161, "Cymel" 1158, "Resimine" 4514 and "Resimine" 354.

The clear coating composition may contain about 5–30% by weight of silsesquioxane compound to provide additional acid etch resistance. Silsesquioxane compounds are oligomers that may be visualized as composed of tetracylosiloxane tings, for example as follows:

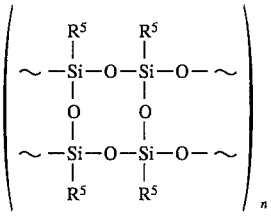

The number of repeating units (n) is suitably 2 or more, preferably 2 to 12. Exemplary compounds, commercially available from Petrarch Systems, Inc. (Bristol, Pa.) include polymethylsilsesquioxane, polyphenylmethylsilsesquioxane, polyphenylpropylsilsesquioxane, polyphenylsilsesquioxane, polyphenyldimethylsilsesquioxane, and polyphenylvinylsilsesquioxane.

Such silsesquioxanes have a plurality of consecutive $SiO_3R^5$-groups, forming SiO cages or "T" structures or ladders. The various rough geometries depend on the n in the above formula, which may vary from 1 to 12 or greater. These silsesquioxane compounds should have at least 1 hydroxy group, preferably at least 4. However, the greater the number of hydroxy groups, the greater the amount of crosslinking. A preferred polysilsesquioxane may be depicted as having the following structural formula:

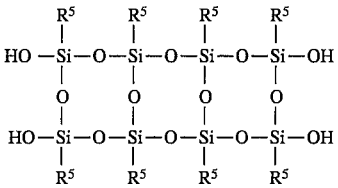

In the above formulas, $R^5$ is a substituted or unsubstituted alkyl, alkoxy or phenyl or combination thereof. Substituents include hydroxy, halo groups such as fluoro, and haloalky groups such as trifuloromethyl. As one example, in the above formula, $R^6$ may consist of about 70 mole percent of phenyl and 30 mole percent propyl. Such a compound is commercially available as Z-6018 from Dow Coming. This compound has a Mw of 1600, 4 SiOH groups, and an OH equivalent weight of 330–360.

The presence of one or mole silsesquioxane compounds in the present composition provides outstanding etch performance in a coating. This may be due to the disproportionate amount of silicon found nearer the top surface of the coating on account of the presence of these compounds.

The clear coating may also contain about 5–30% by weight, based on the weight of the binder, of a silicate which also improves acid etch resistance of the clear coat when UV treated. Typical silicates have the formula

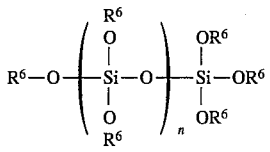

where n=1–10, $R^6$ is $CH_3$, $C_2H_5$ or any $C_3$–$C_{10}$ alkyl or alkylaryl group.

To improve the weatherability of the clear coat, ultraviolet light stabilizers or a combination of ultraviolet light stabilizers can be added to the clear coat composition in the amount of about 0.1–10% by weight, based on the weight of the binder. Such stabilizers include ultraviolet light absorbers, screeners, quenchers, and specified hindered amine light stabilizers. Also, an antioxidant can be added, in the amount 0.1–5% by weight, based on the weight of the binder.

Typical ultraviolet light stabilizers that are useful include benzophenones, triazoles, triazines, benzoates, hindered amines and mixtures thereof. Specific examples of ultraviolet stabilizers are disclosed in U.S. Pat. No. 4,591,533, the entire disclosure of which is incorporated herein by reference. For good durability, a blend of "Tinuvin" 900 (UV screener) and "Tinuvin" 123 (hindered amine), both commercially available from Ciba-Geigy, is preferred.

The clear coating composition may also include other conventional formulation additives such as flow control agents, for example, such as Resiflow™ S (polybutylacrylate), BYK™ 320 and 325 (high molecular weight polyacrylates); and rheology control agents, such as fumed silica.

Conventional solvents and diluents are used to disperse an/or dilute the above mentioned polymers of the clear coating composition. Typical solvents and diluents include toluene, xylene, butyl acetate, acetone, methyl isobutyl ketone, methyl ethyl ketone, methanol, isopropanol, butanol, hexane, acetone, ethylene glycol, monoethyl ether, VM and P naptha, mineral spirits, heptane and other aliphatic, cycloaliphatic aromatic hydrocarbons, esters, ethers and ketones and the like.

The basecoat comprises as the film forming binder a polyurethane, an acrylourethane, an acrylosilane, an acyclic resin and a crosslinking agent such as a polyisocyanate or an alkylated melamine resin. The basecoat can be waterborne or solvent based solution or dispersion. The basecoat contains pigments such as are conventionally used including metallic flake pigments such as aluminum flake.

Both the basecoat and the clear coat are applied by conventional techniques such as spraying, electrostatic spraying, dipping, brushing, flow coating and the like.

After the basecoat and clear coat are applied and fully cured, the coated substrate, such as an automobile or track, is exposed to an artificial source of UV light which emits UV light having a wavelength ranging from about 180–400 nanometers. Typically, a medium pressure mercury lamp is used having about 200–300 watts per linear inch which usually are fused quartz envelopes formed of long tubes with electrodes at both ends. Other suitable light sources that can be used are mercury arcs, carbon arcs, low and high pressure mercury lamps. Exposure to the UV light source is sufficient to increase the resistance of the clear coat to acid etching and water spotting caused by normal weathering.

Typically, UV exposure will provide at least 5,000, preferably 8,000–15,000 milijoules/$cm^2$ of radiation to the clear coat. Preferably, exposure time is about 0.1 second-1 minute/linear foot. The UV source is placed from about 2–60 cm from the clear coating.

The following examples illustrate the invention. All parts and percentages are on a weight basis unless otherwise indicated.

EXAMPLES

The following polymers and resins were prepared and used in Examples 1–9.

Acrylosilane Copolymer A

The following constituents were charged into a mixing vessel equipped with a stirrer:

| | PARTS BY WEIGHT |
|---|---|
| Styrene momomer (S) | 25.0 |

-continued

| | PARTS BY WEIGHT |
|---|---|
| Isobutyl methacrylate monomer (IBMA) | 25.0 |
| n-Butyl methacrylate monomer (nBMA) | 5.0 |
| Hydroxy propyl acrylate monomer (HPA) | 15.0 |
| Gamma-methacryloxypropyl trimethoxy silane monomer (TPM) | 30.0 |
| 2,2'-azobis (2methyl butane nitrile) | 7.5 |
| Total | 107.5 |

The above constituents were mixed and charged into the vessel containing 44 parts of a 2/1 Aromatic 100/n-butanol solvent mixture held at 128° C. with constant mixing over a 4 hour period. The resulting polymer solution had a polymer solids content of about 70.1% and the polymer had a composition of S/IBMA/nBMA/HPA/TPM of 25/25/5/15/30 and a Gardner Holdt viscosity of V and a weight average molecular weight of about 7,000.

Acrylosilane Copolymer B

The following constituents were charged into a mixing vessel equipped as above:

| | PARTS BY WEIGHT |
|---|---|
| Styrene momomer (S) | 25.0 |
| Isobutyl methacrylate monomer (IBMA) | 35.0 |
| n-Butyl acrylate monomer (nBA) | 5.0 |
| Hydroxy propyl acrylate monomer (HPA) | 15.0 |
| Gamma-methacryloxypropyl trimethoxy silane monomer (TPM) | 20.0 |
| "Vazo" 67 - (described above) | 8.0 |
| Total | 108.0 |

The above constituents were mixed and charged into the vessel containing 44 parts of a 2/1 Aromatic 100/n-butanol solvent mixture held at 128° C. with constant mixing over a 4 hour period. The resulting polymer solution had a polymer solids content of about 70% and the polymer had a composition of S/IBMA/nBA/HPA/TPM of 25/35/5/15/20 and a Gardner Holdt viscosity of X and a weight average molecular weight of about 6.200.

Acrylic Polyol C

The following constituents were charged into a mixing vessel equipped with a stirrer:

| | PARTS BY WEIGHT |
|---|---|
| Styrene momomer (S) | 15.0 |
| Butyl methacrylate monomer (BMA) | 30.0 |
| n-Butyl acrylate monomer (nBA) | 17.0 |
| Hydroxy propyl acrylate monomer (HPA) | 38.0 |
| t-Butyl perxoy acetate | 3.0 |
| Total | 103.0 |

The above constituents were mixed and charged into the vessel containing 43 parts of a 3/1 Aromatic 100/xylene solvent mixture held at 128° C. with constant mixing over a 4 hour period. The resulting polymer solution had a polymer solids content of about 70.1% and the polymer had a composition of S/BMA/nBA/HPA/of 15/30/17/38 and a Gardner Holdt viscosity of Z and a weight average molecular weight of about 6,000.

Non-Aqueous Dispersion Resin D

A non-aqueous dispersion resin was prepared by charging the following constituents into a reaction vessel equipped as above containing 56.7 parts of a stabilizer resin solution and polymerizing the constituents: 15 parts styrene monomer (S), 36.5 parts, methyl methacrylate monomer (MMA), 18 parts,methyl acrylate (MA), 25 parts, 2-hydroxyethyl acrylate monomer (HEA), 1.5 parts glycidyl methacrylate monomer (GMA), 4.0 parts methacrylic acid (MAA), 2 parts t-butyl peroctoate. The stabilizer resin solution has a solids content of about 64% in a solvent blend of 85%xylene and 15% butanol and the resin is of styrene, butyl methacrylate, butyl acrylate, 2-hydroxyethyl acrylate, methacrylic acid and glycidyl methacrylate in a weight ratio of 14.7/27.5/43.9/9.8/2.3/1.7. The dispersing liquid for the non-aqueous dispersion is 5% isopropanol, 29% heptane, 54% VMP Naptha, and 12% n-butanol and the dispersion has a 65% solids content and the dispersed polymer particles have a particle size of about 200–300 nanometers.

Silsesquioxane Resin E

The following constituents were charged into a reaction vessel equipped with a stirrer, thermometer, reflux condensor, distillation take off head and heating source:

| | PARTS BY WEIGHT |
|---|---|
| Phenyl trimethoxy silane | 58.0 |
| A-186 - beta-(3,4-epoxy cyclohexyl) ethyl trimethoxy silane | 30.0 |
| PM Acetate | 57.7 |
| Water | 22.8 |
| Formic acid (90% aqueous solution) | 0.2 |
| Total | 103.0 |

The constituents were heated to the reflux temperature of the reaction mixture and volatiles were removed by distillation until the temperature of the reaction mixture reached 120° C. The resulting product has a solids content of about 52% and a Gardner Holdt viscosity (25°) of A1.

EXAMPLES 1–8

Clear coating compositions for Examples 1–8 were prepared as shown in Table A. Each coating composition was reduced to a spray viscosity of 35 seconds, measured with a #2 Fisher Cup. Each of the coating compositions was sprayed onto set of two separate phosphatized steel panels coated with a water based color coat and cured at 130° C. for 30 minutes to provide a clear film about 50 microns in thickness. In each case, one of the panels from each set was exposed for 10 second on a Hanovia Laboratory Model 45080 Ultraviolet Curing System which utilizes a 2400 watt medium pressure mercury lamp, designed to operate at 200 watts per linear inch. Each set of panels, i.e. one treated with UV light and the other untreated were exposed in the Jacksonville Forida area for 15 weeks during the summer months. An evaluation was made to determine the permanent damage to each panel caused by environmental etching. The damage was rated on a 1–12 scale, 1 indicates no damage and 12 indicates most severe damage. Table B shows the test results.

TABLE A

| | Example | | | | | | | |
|---|---|---|---|---|---|---|---|---|
| | 1 | 2 | 3 | 4 | 5 | 6 | 7 | 8 |
| | Description | | | | | | | |
| | Acrylo-silane & Melamine | Acrylo-silane & Silses-quioxane & Melamine | Acrylo-silane | Acrylo-silane & Melamine | Acrylo-silane & Silicate | Acrylo-silane & Melamine & Silicate | Acrylic Polyol & Melamine & Silicate | Acrylo-silane & Melamine & Silicate |
| Cymel 1168[1] | 84.3 | 84.9 | | 65.5 | | 65.5 | 172.6 | 84.3 |
| Dynasil 40[2] | | | | | 65.5 | 65.5 | 100.0 | 79.7 |
| Acrylosilane Copolymer A (prepared above) | 343.7 | 340.7 | | | | | | |
| Acrylosilane Copolymer B | | | 526.0 | 655.3 | 655.3 | 561.4 | | 343.7 |
| Acrylic Polyol C | | | | | | | 240.6 | |
| Nonaqueous Dispersion Resin D | 144.1 | 154.2 | 150.0 | 150.0 | 150.0 | 150.0 | 165.0 | 144.1 |
| Catalyst Type/Amount | A[3]/1.0 B[4]/11.8 | B/15.6 | A/1.1 C[5]/15.8 | A/1.5 C/21.1 | A/1.5 C/21.1 | A/1.5 C/21.1 | 40.0 B/16.1 | A/1.0 B/11.8 |
| Aromatic Solvent 100 | 47.7 | 40.0 | 120.0 | 106.0 | 106.0 | 106.3 | 23.6 | 71.8 |
| "Tinuvin" 900[6] | 4.1 | 4.4 | 4.4 | 5.8 | 5.8 | 5.8 | 5.8 | 4.1 |
| "Tinuvin" 1130[6] | 7.1 | 7.4 | 7.1 | 9.5 | 9.5 | 9.5 | 9.5 | 7.1 |
| "Tinuvin" 123[6] | 7.0 | 7.3 | 7.1 | 9.5 | 9.5 | 9.5 | 9.5 | 7.0 |
| n-butanol | 50.0 | 50.0 | 40.0 | 53.0 | 53.0 | 54.6 | 65.6 | 74.0 |
| Silsesquioxane Resin E | | 67.0 | | | | | | |
| Tetramethylortho acetate | 21.0 | 31.0 | 21.3 | 28.3 | 28.3 | 28.3 | | 21.0 |

[1]alkylated melamine formaldehyde resin, a product of Cytec, Inc.
[2]ortho silicate oligomer, a product of Hüls, America
[3]dibutyl tin diluarate
[4]dodecyl benzene sulfonic acid/amino methyl propanol, 45% in methanol
[5]dodecyl benzene sulfonic acid/diethanol amine, 35% in methanol
[6]"Tinuvin" 900 U.V. light absorber, a product of Ciba-Geigy, Inc. "Tinuvin" 1130 U.V. light absorber, a product of Ciba-Geigy, Inc. "Tinuvin" 123 hindered amine light stabilizer, a product of Ciba-Geigy, Inc.

EXAMPLE 9

This is a comparative example in which a clear coating composition of a glycidyl acrylic polymer crosslinked with a polyanhydride is compared to the acrylosilane coating compositions prepared above. A clear coating composition was prepared by blending together the following constituents:

| | Parts by Weight |
|---|---|
| Acrylic resin solution (72% solids in xylene of an acrylic polymer of styrene/butyl acrylate/cyclohexyl methacrylate/glycidyl methacrylate in a weight ration of 20/5/35/40 having a weight average molecular weight of about 4,100) | 64.1 |
| Polyanhydride solution (80% solids in PM Acetate of a polymer of adipic acid/azelaic acid/isononanoic acid in a molar ratio of 5/5/2 having a weight average molecular weight of about 1000) | 21.0 |
| "Tinuvin" 384 U.V. light absorber | 1.3 |
| "Tinuvin" 292 - vis (N-methyl-2,2,6,6-tetra-methyl piperidinyl) sebacate | 0.6 |
| "Resiflow" S (polybutyl acrylate) | 1.9 |
| Tetramethyl orthoacetate | 3.1 |
| Tetra butyl ammonium bromide | 0.6 |
| "Exxate" 700 (a $C_7$ ester of acetic acid) | 6.7 |
| Total | 99.3 |

The above clear coating composition was spray applied to a set of two phosphated steel panels primed with an elecro-coated primer and waterborne base coat and then cured as described in the previous examples and one panel was treated with UV light and both panels were exposed to weathering in Florida as described in the previous examples. The results of the test are described in Table B.

EXAMPLE 10

This is a comparative example in which a polyurethane clear coat was prepared and compared to the compositions prepared above. A clear polyurethane coating composition was prepared by blending together the following constituents:

| | Parts by Weight |
|---|---|
| Portion 1 | |
| Acrylic polyol solution (66% solids in PM Acetate of a polymer of styrene/butyl meth-acrylate/hydroxyethyl acrylate in a weight ratio of 25/43/32 having a weight average molecular weight of about 5,100) | 567.8 |
| Amorphous silica | 6.7 |
| "Tinuvin" 1130 U.V. light absorber | 14.9 |
| "Tinuvin" 079L hindered amine light stabilizer | 18.9 |
| Acrylic microgel resin (50% solids in an organic carrier of an acrylic resin having a core of methyl methacrylate and an auxiliary acrylic resin stabilizer, the stabilizer/core ratio is 34/66) | 13.3 |
| DC - 57 (silicone oil) | 1.3 |
| Butyl benzyl phthalate | 35.9 |
| Ethyl 3-ethoxy propionate | 15.9 |
| Portion 2 | |
| "Desmodur N 3390 (trimer of hexamethylene | 80.0 |

-continued

| | Parts by Weight |
|---|---|
| diisocyanate) | |
| Butyl acetate | 10.0 |
| Xylene | 10.0 |
| Total | 774.7 |

The above clear coating composition was spray applied to a set of two phosphated steel panels primed with an elecro-coated primer and waterborne base coat and then cured as described in the previous examples and one panel was treated with UV light and both panels were exposed to weathering in Florida as described in the previous examples. The results of the test are described in Table B.

TABLE B

| EXPOSURE RATINGS (FLORIDA EXPOSURE 15 WEEKS | | | |
|---|---|---|---|
| EXAMPLE | COATING TYPE | UV TREATED | UNTREATED |
| 1 | Acrylosilane & melamine | 5 | 8 |
| 2 | Acrylosilane silsesquioxane & melamine | 6 | 8 |
| 3 | Acrylosilane | 5 | 7 |
| 4 | Acrylosilane & melamine | 6 | 8 |
| 5 | Acrylosilane & silicate | 4 | 7 |
| 6 | Acrylosilane, silicate & melamine | 4 | 9 |
| 7 | Acrylic polyol & melamine | 5 | 12 |
| 8 | Acrylosilane, silicate & melamine | 7 | 9 |
| 9 | Glycidyl acrylic & Poly-anhydride | 8 | 5 |
| 10 | 2 Component polyurethane | 7 | 7 |

Exposure ratings are on a scale of 1–12 where 1 indicates no damage and 12 indicates severe damage.

The above data shows that UV light treatment is advantageous to silane containg coating compositions with and without the presence of a melamine crosslinking agent. Example 8 shows that an acrylic polyol melamine containing composition did benefit from UV light treatment as is taught in the art. Example 9 shows that UV light treatment did not improve a glycidyl/anhydride containing composition and Example 10 shows that a two component polyurethane composition is not affected by UV light treatment.

We claim:

1. In a process for forming multiple coats of finishes on a substrate used as the exterior of a motor vehicle other than a testing specimen comprising the sequential steps of (a) applying to the substrate a layer of a color basecoat composition comprising a film forming binder and pigment; (b) applying to the layer of color basecoat composition before the basecoat is fully cured a clear coat composition and subsequently (c) simultaneously curing the basecoat composition and clear coat composition to form a coating; the improvements used therewith comprise the use of a clear coating composition comprising about 40–80% by weight, based on the weight of the clear coating composition, of a binder of an acrylosilane polymer in a liquid carrier and exposing the clear coat of the substrate after curing to an artificial ultraviolet light source under ambient temperature and atmospheric conditions to a sufficient degree to increase the resistance of the coating to water spotting and acid etching when the substrate is exposed to natural outdoor weathering; wherein the acrylosilane polymer consists essentially of polymerized monomers of (1) a hydroxy containing monomer selected from the group consisting of a hydroxy alkyl methacrylate having 1–4 carbon atoms in the alkyl group or a hydroxy alkyl acrylate having 1–4 carbon atoms in the alkyl group;

(2) a silane containing monomer having the following structural formula:

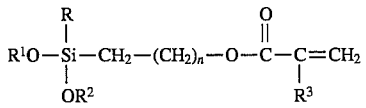

wherein:

R is selected from the group consisting of $CH_3$, $CH_3CH_2$, $CH_3O$, or $CH_3CH_2O$;

$R^1$ and $R^2$ are individually selected from the group consisting of $CH_3$, or $CH_3CH_2$; and $R^3$ is selected from the group consisting of H, $CH_3$, or $CH_3CH_2$ and n is 0 or a positive integer of 1–10; and (3) monomers selected from the group consisting of an alkyl methacrylate having 1–12 carbon atoms in the alkyl group, an alkyl acrylate having 1–12 carbon atoms in the alkyl group, styrene or a mixture of these monomers.

2. The process of claim 1 in which the silane is selected from the group consisting of gamma methacryloxypropyl trimethoxysilane and gamma methacryloxypropyl tris(2-methoxyethoxy)silane.

3. The process of claim 1 in which the binder of the clear coating contains about 10–50% by weight, based on the weight of the binder, of an alkylated melamine formaldehyde crosslinking agent.

4. The process of claim 3 in which the binder of the clear coating contains about 5–30% by weight of a silsesquioxane compound.

5. The process of claims 2 or 3 in which the binder of the clear coating contains about 5–30% by weight of a silicate.

6. The process of claim 1 in which the artificial ultraviolet light source provides at least 5000 millijoules/$cm^2$ of ultraviolet light radiation.

7. The process of claim 6 in which the artificial ultraviolet light source provides from about 8,000–15,000 millijoules/$cm^2$ of ultraviolet light radiation and the ultraviolet light radiation has a wave length in the range of about 180–400 nanometers and is provided by a medium pressure mercury vapor lamp.

* * * * *